United States Patent [19]

Lai

[11] Patent Number: 4,953,774

[45] Date of Patent: Sep. 4, 1990

[54] ELECTRIC STAPLING GUN WITH AUTO-RESET, ENERGY-SAVING AND SHOCK-ABSORBING FUNCTIONS

[75] Inventor: Motor Lai, Taichung-Hsien, Taiwan

[73] Assignee: Regitar Power Tools Co., Ltd., Taya Taichung Hsien, Taiwan

[21] Appl. No.: 344,684

[22] Filed: Apr. 26, 1989

[51] Int. Cl.[5] ..... B25C 5/15

[52] U.S. Cl. ..... 227/131; 227/8; 227/156

[58] Field of Search ..... 227/8, 131, 156

[56] References Cited

U.S. PATENT DOCUMENTS

| | | | |
|---|---|---|---|
| 4,530,454 | 7/1985 | Gloor et al. | 227/131 X |
| 4,618,087 | 10/1986 | Lai | 227/131 |
| 4,640,452 | 2/1987 | Matt et al. | 227/131 |
| 4,807,793 | 2/1989 | Ghibely | 227/131 |
| 4,811,885 | 3/1989 | Lai | 227/131 |
| 4,834,278 | 5/1989 | Lin | 227/131 X |

*Primary Examiner*—Paul A. Bell

*Attorney, Agent, or Firm*—Morton J. Rosenberg; David I. Klein

[57] ABSTRACT

This invention relates to an electric stapling gun with auto-reset, energy-saving and shock-absorbing functions and in particular to one utilizing a lobe of a cam to press a second link rod to turn on a micro-switch once again so as to avoid the dead point of a prior art stapling gun. Further, a spring with different pitches at both ends is used to reduce the work required for producing same momentum on a staple in comparison with the prior art thereby saving energy. In addition, the stapling gun is provided a metallic protective ferrule for keeping the housing of the stapling gun from being damaged.

1 Claim, 9 Drawing Sheets

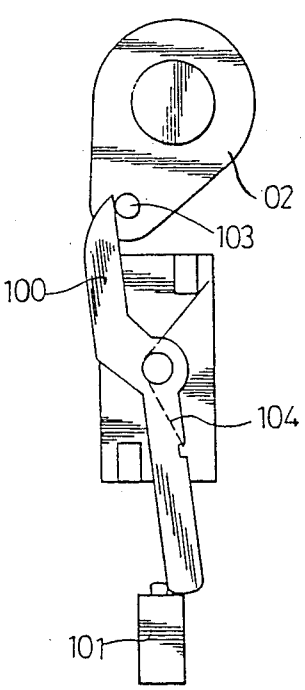
FIG. 5A
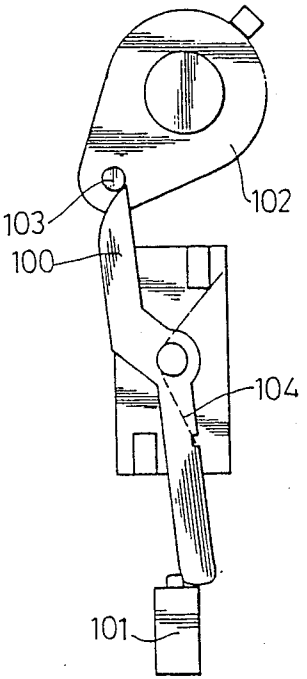
FIG. 5B
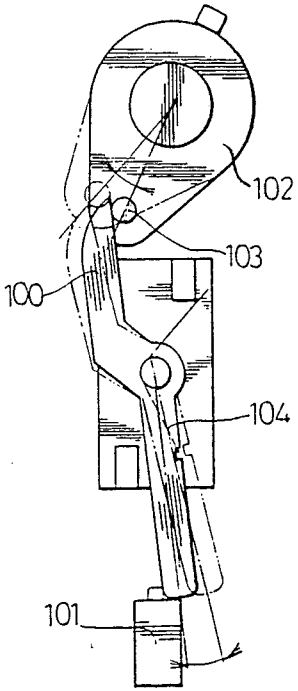
FIG. 5C
FIG. 5D

ELECTRIC STAPLING GUN WITH AUTO-RESET, ENERGY-SAVING AND SHOCK-ABSORBING FUNCTIONS

BACKGROUND OF THE INVENTION

It is found that the prior art stapling gun is controlled by a micro-switch. As illustrated in FIG. 5 when the trigger is pressed, the link rod 100 on the trigger will press the micro-switch 101, turning on the power and actuating the motor. The motor will rotate a cam 102 the pin 103 of which will urge a ram to compress a spring. As the pin 103 of the cam 102 gets out of the hammer, the compressed spring will press the ram to strike a staple out of the stapling gun. The cam 102 will continue to rotate to push the link rod 100 aside and separating the lower end of the link rod 100 from the micro-switch (see FIG. 5C) thereby turning off the power. Hence, when the trigger is pressed once, only a staple will be struck out of the stapling gun thus ensuring safety. However, due to inertia, the cam 102 will continue to rotate for a little while and stop at the position at FIG. 5B, for example. When the trigger is released, the link rod 100 will be moved back to the original vertical position (see FIG. 5A) by the spring 104 waiting for next operation.

Nevertheless, the cam 102 will sometime stop at the position shown in FIG. 5D in case of unstable operation or insufficient power. Meanwhile, the link rod 100 is disposed at an inclined position so that even when the trigger is pressed, the link rod 100 cannot press the micro-switch 101. In short, the link rod 100 is disposed at the dead point. Thus, in order to use the stapling gun, it is necessary to insert a screw driver into the stapling gun to turn on the micro-switch 101 so as to move the link rod 100 away from the dead point.

It is, therefore, an object of the present invention to provide a stapling gun which may obviate and mitigate the above-mentioned drawbacks.

SUMMARY OF THE INVENTION

This invention relates to a power stapling gun with auto-reset, energy-saving and shock-absoring functions.

It is the principle object of the present invention to provide a power stapling gun which utilizes a cam to turn on a micro-switch at the dead point of the prior art power stapling gun so as to actuate the motor once again to move the cam away from the dead point thereby achieving the auto-reset purpose.

It is another object of the present invention to provide a power stapling gun which makes use of a helical spring with different pitches at both ends so as to reduce the energy required for striking the staple.

It is a further object of the present invention to provide a power stapling gun which is provided with a shock absorbing means for decreasing shock and extending the service life thereof.

BRIEF DESCRIPTION OF THE DRAWINGS

FIGS. 5A–5D show how the dead point occurs in the prior art stapling gun;

DETAILED DESCRIPTION OF THE PREFERRED EMBODIMENT

Figure 1:
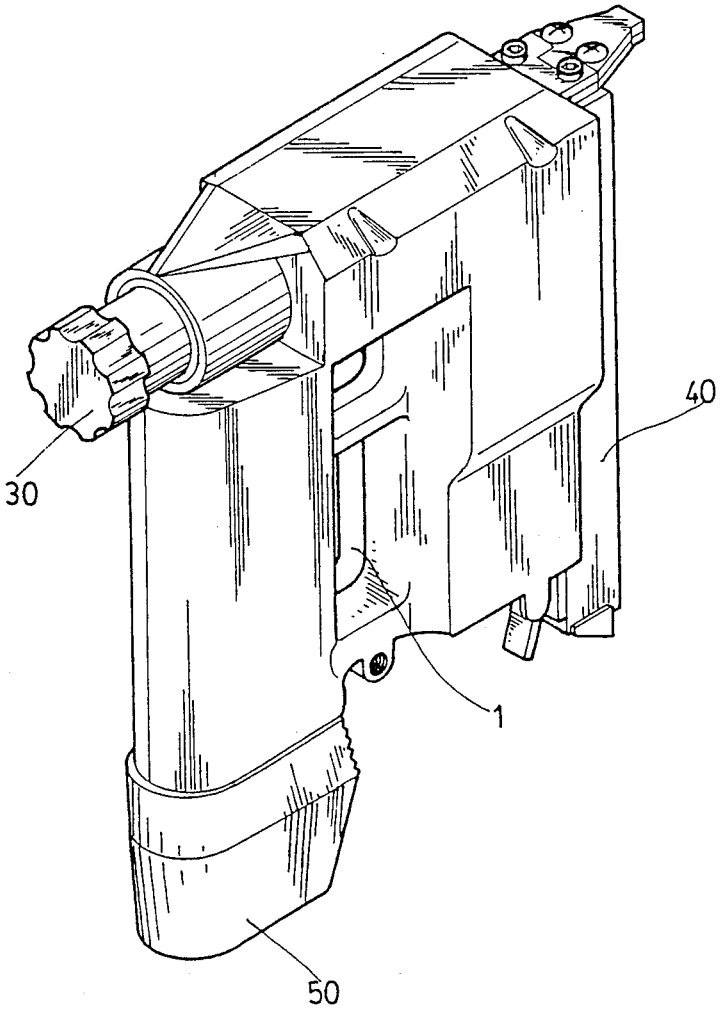
FIG. 1 is a perspective view of a power stapling gun with auto-reset, energy-saving and shock-absorbing functions according to the present invention.
Figure 2:
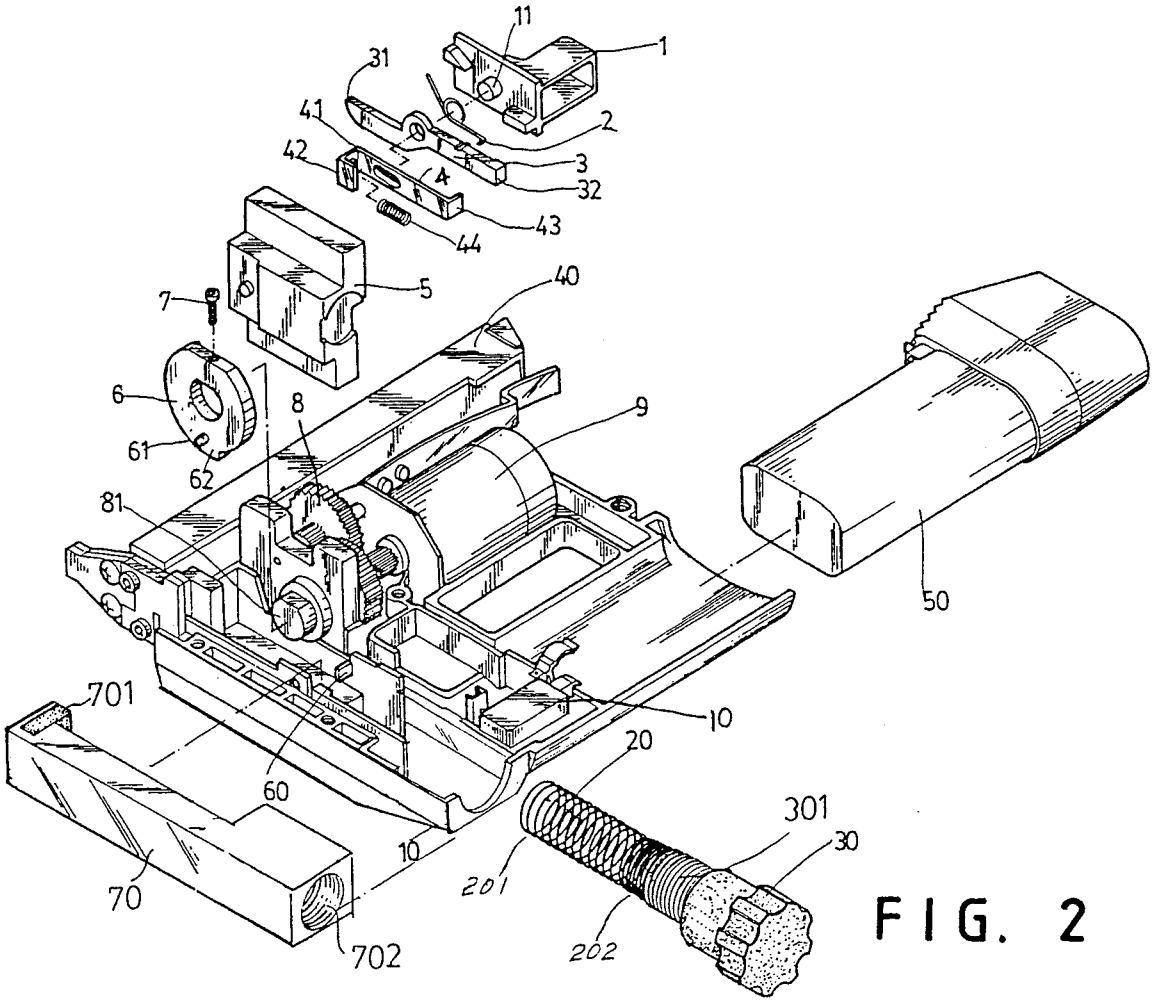
FIG. 2 is an exploded view of the power stapling gun.
Figure 3A:
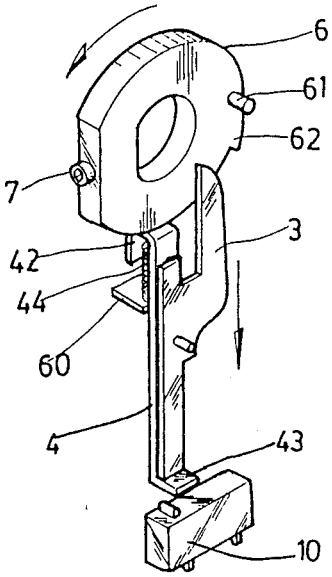
FIGS. 3A–3C show the normal position of the auto-reset means of the power stapling gun.
Figure 3B:
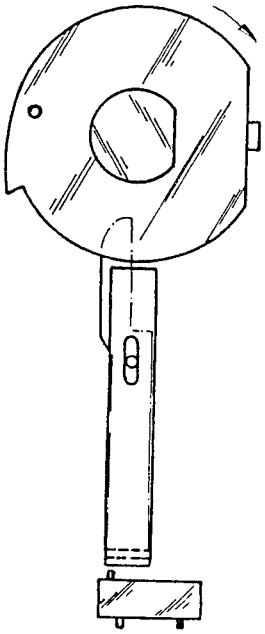
Figure 3C:
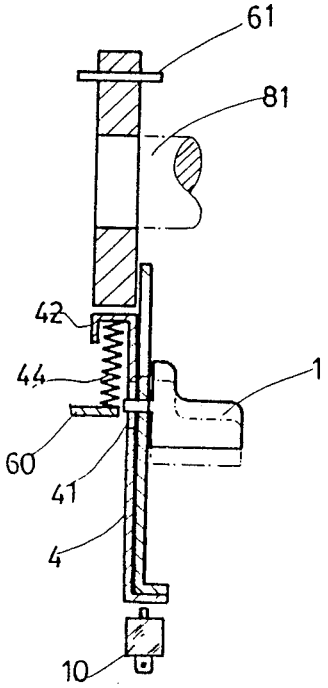

With reference to the drawings and in particular to FIGS. 1 and 2 thereof, the power stapling gun according to the present invention mainly comprises a trigger 1, a first link rod 3, a second link rod 4, a cam 6 and a micro-switch 10. The trigger 1 is mounted in some position near the central part of the stapling gun so as to control the stapling action. The first link rod 3 is pivoted on the inner side of the trigger 1 and kept at a vertical position by a spring 2 normally (see FIG. 3). Hence, when the trigger 1 is pressed, the first link rod 3 will go downwards accordingly. The second link rod 4 is formed with an elongated slot 41 put on to a pin 11 of the trigger 1 and can move upwards and downwards therealong. A spring 44 is disposed between the end 42 of the second link rod 4 and a positioning lug 60 of the house of the stapling gun so as to return the second link rod 4 to its original position when released. At the other end of the second link rod 4 there is a projection 43 for receiving the lower end 32 of the first link rod 3 so that when the first link rod 4 is moved downwards, the second link rod 4 will move downwards too. The cam 6 is fixedly mounted on an output shaft 81 of the gearing 8 the input shaft of which is connected to a driving shaft (not shown) of the motor 9. Consequently, when the motor 9 rotates, the cam 6 will rotate therewith via the gearing 8. One end of the cam 6 has a pin 61 for urging a ram 5 to compress a spring 20 which will push the ram 5 to hit a staple (not shown) out of a guiding groove (not shown) when the cam 6 continues to rotate so that the pin 61 of the cam 6 gets away from the ram 5. The micro-switch 10 is disposed below the first link rod 3 and aligned with the lower end 32 of the first link rod 3 normally. Thus, when the trigger 1 is pressed, the first link rod 3 will move vertically downwards to turn on the micro-switch 10. Therefore, the power supply 50 will be connected to the motor 9 which will carry out stapling action. The threaded nut 30 is used for keeping the spring 20 in the stapling gun and adjusting the force to compress the ram 5.

Figure 4A:
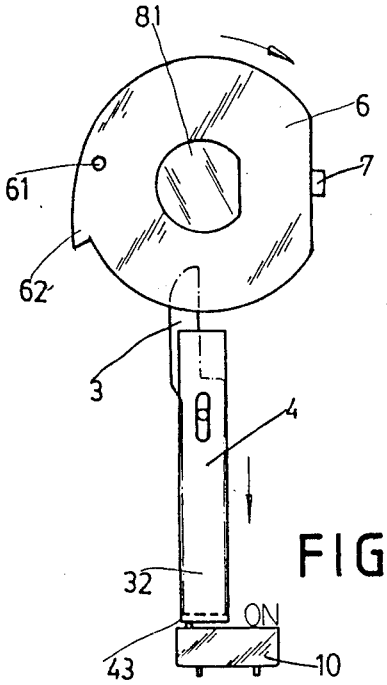
FIGS. 4A–4C show the principle of the auto-reset means of the power stapling gun.
Figure 4B:
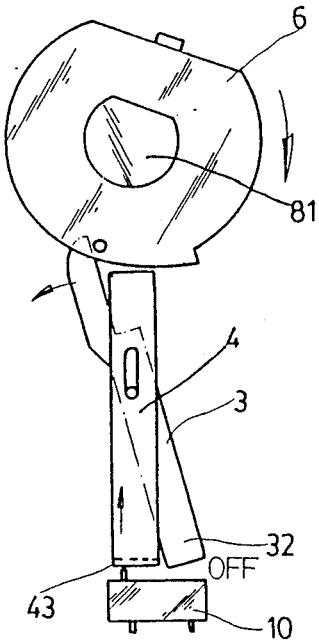
Figure 4C:
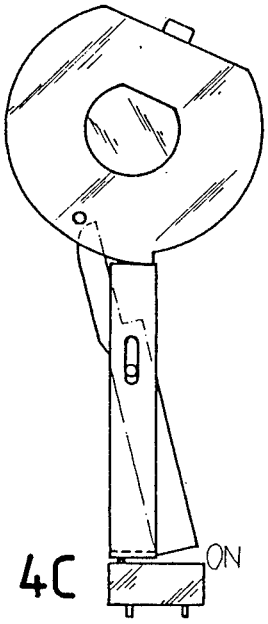

When in use, first press the trigger 1 to move down the first link rod 3 which will press downward the projection 43 of the second link rod 4 thereby activating the micro-switch 10 to connect the power supply 50 to the motor 9. Then, the cam 6 will rotate and the pin 61 thereof will urge the ram 5 to compress the spring 20. As the cam 6 further rotates and the pin 61 gets away from the ram 5, the spring 20 will force the ram 5 to hit a staple out of the guiding groove 40. The cam 6 continues to rotate (see FIG. 4B) and move the first link rod 3 sidewards with the pin 61 hence separating the lower end 32 of the first link rod 3 from the micro-switch 10 and turning off the power supply. In consequence, the cam 6 will stop hitting the ram 5 and so only a staple will be hitted out when the trigger 1 is pressed down once thus ensuring safety. In case the cam 6 stops at the dead point of the prior art electric stapling gun (see FIG. 4B), the lobe 62 of the cam 6 will press the second link rod 4 the projection 43 of which will turn on the micro-switch 10 activating the motor 9 again so as to move the cam 6 to get away from the dead point and achieving the auto-reset purpose. When the cam 6 continues to rotate so that the lobe 62 thereof gets away from the second link rod 4, the second link rod 4 and the first link rod 3 will return to their orginal positions by means of the springs 43 and 2.

Figure 6A:
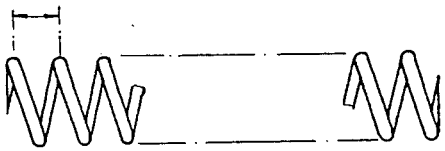
FIGS. 6A–6C show the energy-saving principle of the power stapling gun.
Figure 6B:
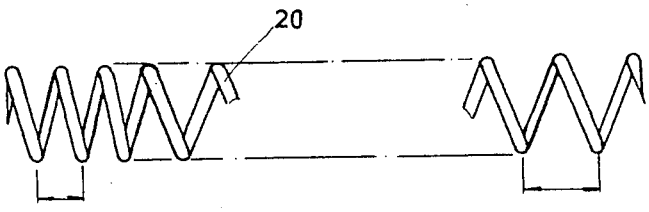
Figure 6C:
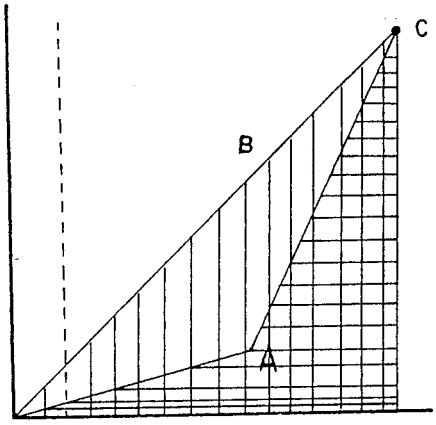
Figure 7:
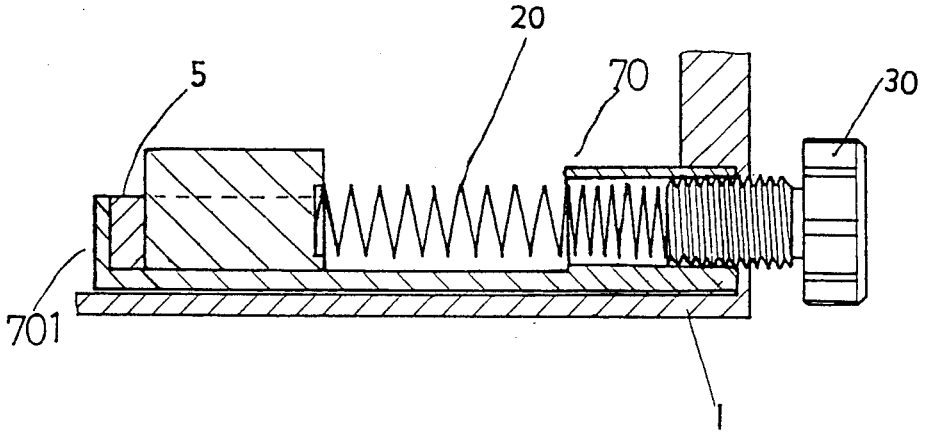
FIG. 7 shows the construction of the shock-absorbing means of the power stapling gun.
Figure 8A:
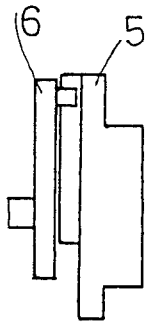
FIGS. 8*a* and 8*b* show how the ram works.
Figure 8B:
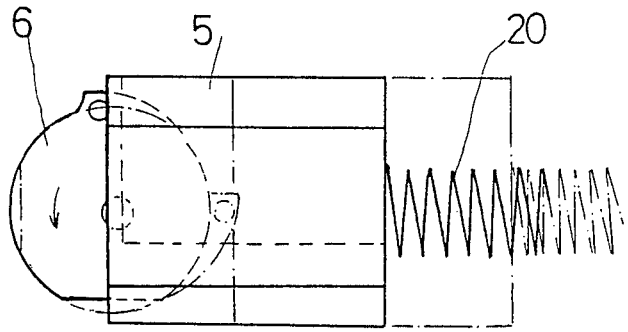
Figure 9:
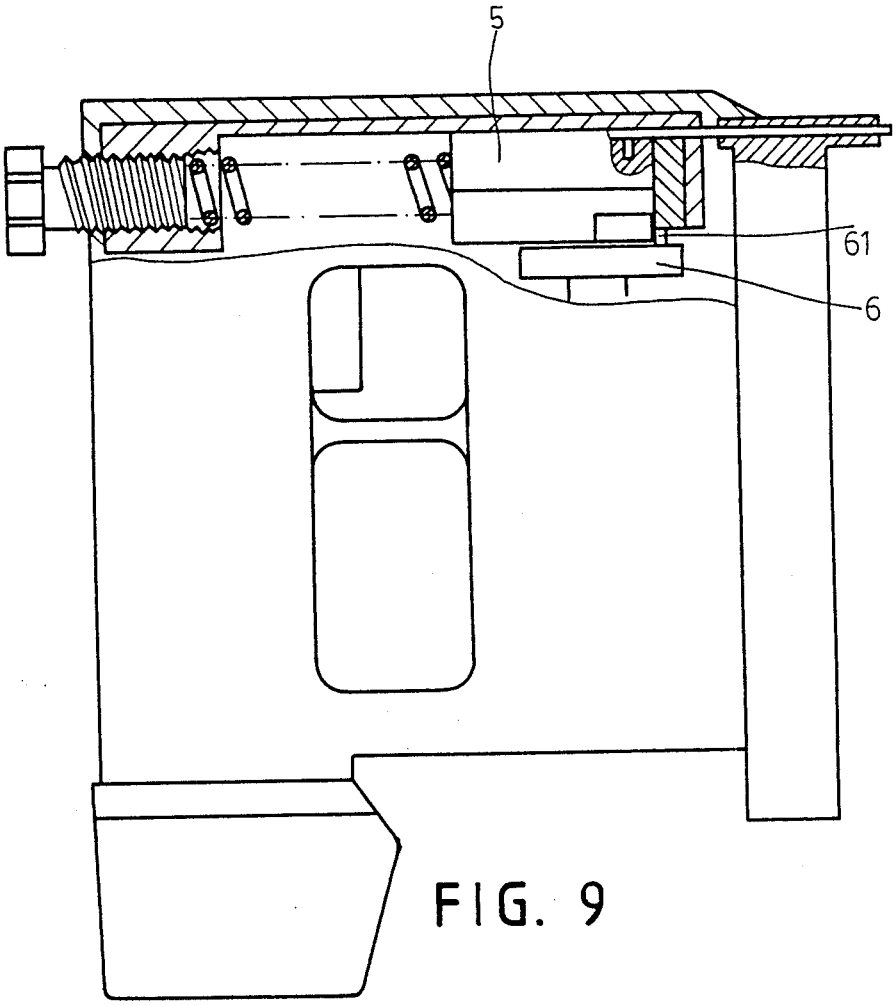
FIG. 9 is a cut away view showing how the ram works.

Referring to the FIGS. 2, 6 and 7, one end 201 of the spring 20 has a large pitch than the other end 201 thereof. Looking again at FIG. 2, the work required by the spring 200 with equidistant pitch compressed to point C is equal to the area under line B while the work required by the present spring 20 with different pitches compressed to point C is equal to the area under line A. As illustrated, the area under line A is smaller than that under line B. In brief, the present invention will require a lesser work than the prior art in order to render the same momentum to the staple thereby saving electric power. Further, as shown in FIG. 6, the force for compressing the spring 20 is smaller at the beginning and so the impact at the last stage will be smaller too, hence relieving the destruction caused by impact and extending the service life of the driving mechanism as well.

FIG. 7 shows a sectional view of the shock-absorbing means of the present invention. As can be seen, the shock-absorbing means 70 comprises a metallic protective ferrule embedded on the housing of the electric stapling gun so as to strengthen construction thereof. The right end of the shock-absorbing means 70 is provided with internal threads 702 for engaging with external threads 301 of the threaded nut 30. The spring 20 is mounted at the left side of the threaded nut 30 and the ram 5 is partially disposed within the metallic protective ferrle and urged by the spring 20 to bear against a piece of rubber pad 701 at the left end of the metallic protective ferrule. Hence, when the trigger 1 is pressed, the motor 9 rotates to drive the cam 6 the pin 62 of which will urge the ram 5 to compress the spring 20. As the pin 62 of the cam 6 gets away from the ram 5, the compressed spring 20 will push the ram 5 to hit a staple out of the guiding groove 40. Since the shock-absorbing means 70 is directly engaged with the threaded nut 30 and the ram 5 may slide within the shock-absorbing means 70, the ram 5 will not directly strike on the housing of the electric stapling gun. In addition, the rubber pad 701 is used to absorb the shocking when the ram 5 is pushed out by the spring 20 thus reducing the internal stress and the keeping the housing from being damaged. Further, the oscillation is reduced and the service life is extended.

Although this invention has been described with a certain degree of particularity, it is understood that present disclosure is made by way of example only and that numerous changes in the construction and the combination and arrangement of parts may be resorted to without departing from the spirit and scope of the invention as hereinafter claimed.

I claim:

1. An electric stapling gun comprising:

a trigger mounted in the stapling gun:

a first link rod pivoted on an inner side of said trigger and capable of moving therewith;

a second link rod formed with an elongated slot put on to a pin on the inner side of said trigger and a projection for receiving a lower end of said first link rod so that said second link rod will move downwards when said first link rod is pressed and will return to original position by means of a spring when said trigger is released;

a cam fixedly mounted on an output shaft of a gearing and having a lobe on which there is a pin for pushing a ram, said lobe being designed such that when said cam rotates, said lobe will push said first link rod away from said micro-switch and press said second link rod to activate said micro-switch once again;

a micro-switch disposed below said first link rod so that when said trigger is pressed to move said first link rod downwards, said first link rod will turn on said micro-switch with a lower end thereof and connect a power supply to a driving motor to rotate said cam so as to urge said ram to hit a staple out of said stapling gun;

a spring with different pitches at both ends and used to push said ram to carry out stapling action; and a metallic protective ferrule fixedly mounted in said electric stapling gun and used to receive said spring and part of said ram and having a rubber pad on an inner end thereof.

* * * * *